United States Patent [19]

Sato et al.

[11] Patent Number: 4,556,609

[45] Date of Patent: Dec. 3, 1985

[54] HEAT-RESISTANT GALVANIZED IRON ALLOY WIRE

[75] Inventors: Ken-ichi Sato; Satoshi Takano; Kenji Miyazaki, all of Osaka, Japan

[73] Assignee: Sumitomo Electric Industries, Ltd., Osaka, Japan

[21] Appl. No.: 564,876

[22] Filed: Dec. 23, 1983

[30] Foreign Application Priority Data

Dec. 24, 1982 [JP] Japan ..... 57-234317

[51] Int. Cl.[4] ..... C23C 1/02

[52] U.S. Cl. ..... 428/659; 428/607; 427/433

[58] Field of Search ..... 428/659, 607, 658; 427/433

[56] References Cited

U.S. PATENT DOCUMENTS 2,986,808 6/1961 Schnedler ..... 428/659
4,029,478 6/1977 Lee ..... 428/659
4,056,366 11/1977 Lee et al. ..... 428/659
4,152,472 5/1979 Ohbu et al. ..... 427/433

FOREIGN PATENT DOCUMENTS 0715516 8/1965 Canada ..... 428/659
0110659 7/1982 Japan ..... 428/659

*Primary Examiner*—L. Dewayne Rutledge
*Assistant Examiner*—Deborah Yee
*Attorney, Agent, or Firm*—Sughrue, Mion, Zinn, Macpeak & Seas

[57] ABSTRACT

A heat-resistance galvanized iron alloy wire is disclosed. The wire is comprised of an iron alloy wire core which may be an Fe-Ni type alloy. The core is coated on its periphery with a Zn-Al alloy. The alloy is comprised of 0.2 to 14 wt % Al with the balance being Zn. The Zn-Al alloy may contain small amounts of typical impurities or compounds included in order to prevent the oxidation of the Zn or Al. The resulting wire has excellent heat-resistant properties.

10 Claims, No Drawings

HEAT-RESISTANT GALVANIZED IRON ALLOY WIRE

FIELD OF THE INVENTION

This invention relates to a galvanized iron alloy wire, and more particularly to a heat-resistant galvanized iron alloy wire which excels in resistance to heat.

BACKGROUND OF THE INVENTION

In recent years, heat-resistant steel-core aluminum strands (hereinafter referred to as ACSR) have been used for the purpose of increasing power transmission capacity and improving reliability of power systems by one-line operation when there is trouble during the two-line operation. The iron alloy wires incorporated in such heat-resistant ACSR's for field use are generally obtained by coating steel wires of ACSR grade with aluminum or zinc.

Although the Al coating is excellent in resistance to corrosion and heat, it is expensive. The zinc coating improves the resistance fo ACSR to corrosion, if to a lesser extent than the Al coating, and is inexpensive. It nevertheless forms an Fe-Zn compound and loses toughness on exposure to heat. Further, zinc plating tends to be stripped at high temperatures as described in *Nippon Kinzoku Gakkai Shi* 39 (1975) pp 903–908. Since the temperature at which the ACSR's are used may rise as high as 245° C. at times, the zinc coating has failed to find extensive utility in application to cores of heat-resistant ACSR's .

SUMMARY OF THE INVENTION

This invention, perfected with a view to eliminating the drawbacks suffered by conventional ACSR's as described above, is aimed at providing a galvanized iron alloy wire having a zinc coating of notably improved thermal resistance such that the iron alloy wire may acquire thermal resistance optimum for the wire to be used in heat-resistant ACSR's in particular.

To be specific, this invention relates to a heat-resistant galvanized iron alloy wire comprising an iron alloy wire and a coating formed on the periphery of said iron alloy wire with a Zn-Al alloy substantially comprising 0.2 to 14 wt % of Al and the balance of Zn and including inevitably entrained impurities.

DETAILED DESCRIPTION OF PREFERRED EMBODIMENTS

The iron alloy wire to be used in this invention is formed of steel, special steel incorporating some alloy element, or an iron alloy. The Fe-Ni type alloy which is attracting keen attention on account of its small thermal expansion coefficient may be adopted as an iron alloy for this invention. This particular alloy may incorporate 35 to 42 wt % of Ni or incorporate a total of 0.2 to 10 wt % of at least one element selected from the group consisting of Cr, Mo, Si, Mn, C, Nb, Co, Al, Mg, and Ti. The incorporation of such additive elements is expected to bring about an effect of either strengthening the Fe-Ni type alloy or preventing the thermal expansion coefficient from being increased.

Examples of the iron alloy wires which can be used in the present invention include a steel wire consisting of 0.62 wt % of C, 0.27 wt % of Si, 0.73 wt % of Mn and the balance being Fe and unavoidable impurities, a steel wire consisting of 0.80 wt % of C, 0.22 wt % of Si, 0.70 wt % of Mn and the balance being Fe and unavoidable impurities, and an Fe-Ni alloy wire consisting of 35 to 40 wt % of Ni, 2 to 5 wt % of Co, 0.2 to 0.8 wt % of C, 0.2 to 0.8 wt % of Si, 0.2 to 0.8 wt % of Mn and the balance being Fe and unavoidable impurities.

Formation of the Zn-Al type alloy coating on the iron alloy wire contemplated by this invention can be accomplished by any of various coating methods such as, for example, fusion, cladding, or extrusion.

The present invention will now be described below with reference to a galvanized iron alloy wire for use in ACSR's. This invention is not limited to the galvanized iron alloy wire for this particular application. It embraces galvanized iron alloy wires intended for incorporation into structural materials which by nature are used under conditions not incapable of inducing elevation of temperature.

Generally, an iron alloy and Zn react to produce three compound layers, $\gamma$(gamma), $\delta$(delta), and $\zeta$(zeta), when fused Zn is deposited on the iron alloy or when the iron alloy already coated with Zn is heated. These Fe-Zn compounds impair the toughness of the galvanized iron alloy. When the galvanized iron alloy is heated at 300° C. for 100 hours, for example, the vibratory fatigue strength thereof is degraded. Heating at 300° C. for 100 hours also lowers the number of twists notably and under extreme conditions, results in separation of alloy layers along the interfaces in some, if not all, cases.

For the purpose of curbing the growth of such compound layers, the present invention adds 0.2 to 14 wt % of Al to Zn. The addition of 0.2 to 14 wt % of Al to Zn curbs the otherwise possible growth of the compound layers formed between the Fe alloy and the Zn alloy while fused Zn is deposited on the iron alloy or when the iron alloy coated with Zn is heated. This addition is not effective when the amount of Al thus added is less than 0.2 wt %. Further, the effect of curbing the growth of such compound layers is saturated and the viscosity of the fused Zn-Al alloy is increased and the separation of the coated iron alloy is seriously spoiled when the amount of Al so added exceeds 14 wt %.

Preferably, the amount of Al to be added falls in two ranges, 0.2 to 1.0 wt % and 4.5 to 5.5 wt %, and most preferably the range is from 0.2 to 1.0 wt %. If the amount of Al exceeds 1.0 wt %, the Al component in the fused Zn-Al alloy undergoes oxidation to produce dross and induces rigorous formation of $Al_3Fe$ due to the reaction with the iron alloy wire, making it necessary to pay due attention to controlling the amount of the Al component. If the amount of Al falls in the range of 4.5 to 5.5 wt %, although the control of the Al component becomes difficult, the resultant Zn-Al alloy becomes an azeotrope possessing a low melting point. Accordingly, the coating work can be carried out at lower temperatures, reducing the thermal effect exerted on the iron alloy wire.

Further, the present invention facilitates the control of the components of the Zn-Al alloy by adding thereto Be, Ca, and rare earth elements such as La and/or Ce, which are capable of preventing Zn and Al from oxidation. The amount of these elements to be added thereto is properly selected in the range of 0.001 to 0.1 wt %, e.g., 0.005 wt %.

EXAMPLE 1

As steel wires for ACSR, steel wires conforming to the specification of JIS G-3506 were prepared. These steel wires were processed by the combination of drawing and heating treatments to afford steel wires having a tensile strength of 133 kg/mm$^2$ and measuring 2.9 mm in diameter. These wires were mechanically abraded and electrolytically abraded in a sulfuric acid bath, immersed in a flux solution of $NH_4Cl$-$ZnCl_2$ for 20 seconds, then dried, and immersed in Zn-Al alloy bath of a varying mixing ratio indicated in Table 1 at a temperature 30° C. higher than the liquid-phase curve for 30 seconds to coat the wires with Zn-Al alloy. After the immersion, the coated wires were tested for appearance, tensile strength, number of twists in situe, number of twists after heating at 300° C. for 100 hours, and possible separation of the Zn layer during the test for twisting. The results were as shown in Table 1.

TABLE 1

| Test | No. | Al content (wt %) of Zn—Al bath | Appearance | Tensile strength kg/mm$^2$) | Number of twists (twists/100D) | After heating at 300° C. for 100 hrs. Number of twists (twists/100D) | Separation of Zn |
|---|---|---|---|---|---|---|---|
| Comparative | 1 | 0 | Good | 126 | 34 | 13 | Yes |
| Experiment | 2 | 0.1 | " | 127 | 33 | 12 | " |
| This | 3 | 0.3 | " | 126 | 36 | 34 | No |
| Invention | 4 | 0.5 | " | 126 | 34 | 35 | " |
| | 5 | 0.8 | " | 127 | 35 | 35 | " |
| | 6 | 4.9 | " | 129 | 34 | 34 | " |
| | 7 | 10.2 | Relatively good | 126 | 36 | 36 | " |
| Comparative | 8 | 18.6 | Poor | 124 | 34 | 35 | " |
| Experiment | 9 | 22.0 | " | 122 | 36 | 35 | " |

From Table 1, it is noted that the samples of Run Nos. 3–7 according to this invention had good appearance after coating, exhibited high tensile strength, and showed a large number of twists. They retained the number of twists intact and showed no sign of separation of Zn layer during heating at 300° C. for 100 hours.

In contrast, the samples of Run Nos. 1–2 which had lower Al contents in the Zn-Al alloy than specified had their number of twists lowered and underwent separation of the Zn layer during heating. The samples of Run Nos. 8–9 which had excessive Al contents had their appearance seriously impaired.

EXAMPLE 2

The same steel wires as used in Example 1 were immersed in Zn-Al alloy bath having a varying mixing ratio as indicated in Table 2 at a temperature 30° C. higher than liquid-phase curve for a varying period. They were tested for possible separation of the Zn layer while measuring the number of twists. The results are as shown in Table 2.

TABLE 2

| Test | No. | Al content (wt %) of Zn—Al bath | Length of immersion time (seconds) 20 | 30 | 60 | 120 | 180 |
|---|---|---|---|---|---|---|---|
| Comparative | 10 | 0 | No | No | Yes | Yes | Yes |
| Experiment | 11 | 0.1 | " | " | " | " | " |
| This | 12 | 0.3 | " | " | No | No | No |
| Invention | 13 | 0.4 | " | " | " | " | " |
| | 14 | 0.8 | " | " | " | " | " |
| | 15 | 5.2 | " | " | " | " | " |

From Table 2, it is noted that the samples of Run Nos. 12–15 according to the present invention induced no separation of the Zn layer while measuring the number of twists subsequent to coating and exhibited ample adhesion of the coating to the substrate even when the immersion time was varied over a wide range. Thus, the present invention has an advantage that the production conditions can be selected over a wide range.

In Run Nos. 12–15, the samples fresh out of coating with Zn and the samples which had undergone heating at 300° C. to 100 hours were tested for tensile strength, elongation, number of twists, fatigue strength, and possible separation of the Zn layer while measuring the number of twists.

The numerical value of the test results after the heating were equal to those after the coating in all the samples. None of the samples showed any sign of separation of the Zn phase while measuring the number of twists.

When the component of the Zn layer in the cross section of the wire after the heating was subjected to electron probe microanalysis (EPMA), formation of an intermetallic compound of Fe-Zn was not observed. Thus, the samples served to demonstrate the high effect of the Al-Zn alloy in curbing the growth of such an intermetallic compound.

EFFECT OF THE INVENTION

The heat-resistant galvanized iron alloy wire of the present invention constructed as described above brings about the following effects.

The invention produces a heat-resistant galvanized iron alloy wire by depositing on the periphery of an iron alloy wire a coating of Zn-Al alloy substantially comprising 0.2 to 14 wt % of Al and the balance of Zn and including inevitably entrained impurities. Inclusion of Al in the coating curbs the growth of the Fe-Zn compound layer even when the coated iron alloy wire is exposed to heat during immersion in a fused alloy bath or heat used in thermal treatment performed after the Zn coating. Thus, the coated wire does not suffer from loss of toughness, strength or induce separation of the Zn layer. Compared with conventional galvanized iron alloy wires, the galvanized iron alloy wire of the present invention exhibit notably improved thermal resistance capable of withstanding elevated temperatures (about 300° C.).

The galvanized iron alloy wire of this invention provide very desirable materials which can be used as galvanized iron alloy wires or galvanized steel wires. These wires can be used for use in structural members such as, for example, reinforcing members in heat-resistant ACSR's. These wires can be used under elevated temperature conditions.

While the invention has been described in detail and with reference to specific embodiment thereof, it will be apparent to one skilled in the art that various changes and modifications can be made therein without departing from the spirit and scope thereof.

What is claimed is:

1. A heat-resistant galvanized iron alloy wire, comprising:

an iron alloy wire core; and a coating formed on the periphery of the iron alloy wire core, the coating consisting essentially of a Zn-Al alloy consisting essentially of 0.2 to 1.0 wt % of Al and the balance of Zn and inevitably entrained impurities, wherein the wire core is comprised of an Fe-Ni type alloy containing 35–42 wt % of Ni.

2. A heat-resistant galvanized iron alloy wire as claimed in claim 1, wherein the Zn-Al alloy contains 0.2 to 0.5 wt % of Al.

3. A heat-resistant galvanized iron alloy wire as claimed in claim 2, wherein the Zn-Al alloy contains 0.2 to 0.4 wt % of Al.

4. A heat-resistant galvanized iron wire as claimed in claim 1, wherein the Fe-Ni type alloy is comprised of 35 to 42 wt % Ni and a total of 0.2 to 10 wt % of an element selected from the group consisting of Cr, Mo, Si, Mn, C, Nb, Co, Al, Mg, and Ti, the remainder of the alloy being Fe.

5. A heat-resistant galvanized iron alloy wire, comprising:

an iron alloy wire core; and a coating formed on the periphery of the iron alloy wire core, the coating consisting essentially of a Zn-Al alloy consisting essentially of 0.2 to 1.0 wt % Al, 0.001 to 0.1 wt % of an element selected from the group consisting of Be, Ca, and rare earth elements capable of preventing oxidation of Zn and Al, the remainder of the alloy being Zn, wherein the core is comprised of an Fe-Ni type alloy containing 35 to 42 wt % of Ni.

6. A heat-resistant galvanized iron wire as claimed in claim 5, wherein the Zn-Al alloy contains 0.2 to 0.5 wt % of Al.

7. A heat-resistant galvanized iron wire as claimed in claim 5, wherein the Zn-Al alloy contains 0.2 to 0.4 wt % of Al.

8. A heat-resistant galvanized iron wire as claimed in claim 5, wherein the Fe-Ni type alloy is comprised of 35 to 42 wt % of Ni and a total of 0.2 to 10 wt % of an element selected from the group consisting of Cr, Mo, Si, Mn, C, Nb, Co, Al, Mg, and Ti, the remainder of the alloy being Fe.

9. A heat-resistant galvanized iron alloy wire, comprising:

an iron alloy wire core; and a coating formed on the periphery of the iron alloy wire core, the coating consisting essentially of a Zn-Al alloy consisting of 0.2 to 1.0 wt % of Al and the balance of Zn and inevitably entrained impurities, wherein the wire core is comprised of an Fe-Ni type alloy containing 35–42 wt % of Ni.

10. A heat-resistant galvanized iron alloy wire, comprising:

an iron alloy wire core; and a coating formed on the periphery of the iron alloy wire core, the coating consisting essentially of a Zn-Al alloy consisting of 0.2 to 1.0 wt % Al, 0.001 to 0.1 wt % of an element selected from the group consisting of Be, Ca, and rare earth elements capable of preventing oxidation of Zn and Al, the remainder of the alloy being Zn, wherein the core is comprised of an Fe-Ni type alloy containing 35–42 wt % of Ni.

* * * * *